US005566629A

United States Patent [19]

Satterfield

[11] Patent Number: 5,566,629

[45] Date of Patent: Oct. 22, 1996

[54] TUFTING MACHINE PATTERNING APPARATUS

[75] Inventor: William H. Satterfield, Dalton, Ga.

[73] Assignee: Spencer Wright Industries, Inc., Dalton, Ga.

[21] Appl. No.: 420,127

[22] Filed: Apr. 11, 1995

[51] Int. Cl.[6] ..... D05C 15/16

[52] U.S. Cl. ..... 112/80.01; 112/80.7

[58] Field of Search ..... 112/80.73, 80.72, 112/302, 80.7, 80.01

[56] References Cited

U.S. PATENT DOCUMENTS

| | | | |
|---|---|---|---|
| 3,207,105 | 9/1965 | Card et al. | 112/80.72 |
| 3,687,095 | 8/1972 | Jackson | 112/80.73 X |
| 4,870,915 | 10/1989 | Bagnall | 112/80.73 X |

FOREIGN PATENT DOCUMENTS

| | | | |
|---|---|---|---|
| 397443 | 11/1990 | European Pat. Off. | 112/80.73 |

*Primary Examiner*—Paul C. Lewis
*Attorney, Agent, or Firm*—Alan Ruderman

[57] ABSTRACT

A tufting machine includes a pattern attachment mounted between a yarn feeding device and the needles, the yarn feeding device feeding yarn to the needles at a constant rate in an amount sufficient to accommodate the yarn requirements of the needle and looper system. The pattern attachment includes a series of slats rotatable about an axis in timed relationship to the reciprocation of the needles. Each slat includes a yarn receiving groove corresponding to each needle, certain of the grooves being shallower than others. A first yarn guide directs yarn from the feeding device to the pattern attachment while a second yarn guide directs yarn from the pattern attachment toward the needles. The slats are mounted on chains fastened to sprockets mounted on a driven shaft. The yarn is tensioned so that the full amount of yarn fed by the feeding device may be received by the needles, and when yarn enters a shallow groove, the yarn is pulled back from the respective needle resulting in a loop that is shorter than when the full amount of yarn is received by the needle.

6 Claims, 3 Drawing Sheets

TUFTING MACHINE PATTERNING APPARATUS

BACKGROUND OF THE INVENTION

This invention relates to tufting machines and more particularly to a pattern attachment for a tufting machine for forming high pile and low pile tufts in the same row of stitching in accordance with a pattern determined by grooves or slots cut into a set of rotating slats.

In the production of tufted fabrics a plurality of spaced apart yarn carrying needles extend transversely across the tufting machine and are reciprocated cyclically to penetrate and insert loops of yarn into a backing material fed longitudinally through the machine. The loops are seized by respective loopers or hooks oscillating below the backing material in timed relationship with the needles as the loopers or hooks cross the needles just above the needle eye.

In loop pile machines the loopers point in the direction of feed of the backing material and hold the seized loops while the needles are retracted from the backing material. The loopers thereafter rock away from the point of loop seizure to release the loops. When the needles start their next descent the loops have been released from the loopers and carried one stitch length away from the needle path. In cut pile machines the hooks point in the direction opposite to the direction in which the backing material is fed so that the loops are fed onto the closed end of the hooks and each hook cooperates with a respective oscillating knife to cut the loops thereon in seriatim.

Although the pile height of cut pile fabric depends solely upon the distance that the hooks are disposed beneath the backing material, the pile height of loop pile fabric depends on the amount of yarn fed to the needles with the maximum being the distance from the loopers to the backing material. If the yarn fed to a particular needle is reduced, a low pile height loop will result. To control the supply of yarn, various methods have been devised in the prior art varying in complexity and versatility. Since a needle requires a certain amount of yarn so that it may shed a loop which is seized by a looper, when less yarn is fed than required by the needle, yarn will be pulled back or "back-robbed" from the prior stitch This is the basis for forming fabric with differing pile heights.

Wide use is made of yarn feed roller pattern attachments or assemblies for producing variations in pile height in tufted pile fabrics such as carpeting. These assemblies include a plurality of yarn feed rollers which feed yarn at different speeds to the needles of the tufting machine. Each of the feed rollers is selectively driven at one of a plurality of different speeds independently of the other feed rollers by means of clutches controlled by a pattern control. The amount of yarn supplied to the needles of the tufting machine is determined by the rotational speed of the feed rollers about which the yarn is wound, so that with a fixed needle stroke the amount of yarns supplied to each needle determines the pile height of the fabric produced. To create patterned pile effects the amount of yarn fed to the individual needle may be varied by driving the feed rollers selectively at the different speeds. When less yarn is fed than required by the needle, yarn is pulled back or back-robbed from the previous stitch which then becomes a lower loop. By feeding yarn at two or three speeds in a controlled manner, patterns may be formed by the different pile heights. Thus, high and low loops may be produced, or even three levels of loop when feed rollers of three different speeds are provided.

Representative of such feed roller pattern attachments are those disclosed in U.S. Pat. Nos. 2,862,465 (Card); 2,875,714 ( Nix); 2,966,866 (Card); 3,001,388 (MacCaffary); 3,075,482 (Card); 3,103,187 (Hammel); 3,134,529 (Beasey); 3,272,163 (Erwin et al); 3,375,797 (Gaines); 3,489,326 (Singleton); 3,605,660 (Short); 3,752,094 (Short); 3,947,098 (Hammel); 3,926,132 (Lear et al); 3,955,514 (Prichard et al); 4,134,348 (Scott); 4,608,935 (Bardsley); and 5,182,997 (Bardsley).

Other types of pattern attachments may be used such as those having grooved or slotted slats as disclosed, for example, in U.S. Pat. Nos. 2,853,032 (Odenweller); 2,853,033 (Crawford); and 2,853,034 (Crawford). These pattern attachments comprise two sets of intermeshing slats mounted on a continuously moving roller chain. V-notches on one set are constant in height, but those on the other set, or pattern slats, vary in height according to the pattern requirements. As the two sets of slats intermesh, the length of yarn available for each tuft depends upon the extent to which the yarn is deflected by the depth of cut on the pattern slat.

The simplest of all prior art devices comprises a series of grooved cam disks which are eccentrically mounted on a drive shaft. A yarn strand is received within each respective groove in its path to a respective needle and as the disks rotate the tension of each yarn running in the groove changes and, as a result, differences in pile height are created. This method is limited to very simple loop pile patterns with very small repeats.

The desirability of providing a relatively simple pattern attachment that may produce random high and low, and also intermediate, loop pile fabric within a number of stitches substantially greater, i.e., a greater pattern repeat, than that produced by the cam disk pattern attachment is apparent. Presently, to provide such a pattern array involves utilization of one of the more complicated and costly aforesaid yarn feed roller attachments or intermeshing slat pattern attachments.

SUMMARY OF THE INVENTION

Consequently, it is a primary object of the present invention to provide a simple pattern attachment for tufting machines for producing high and low loop patterns with a random look.

It is another object of the present invention to provide a mechanical pattern attachment for a tufting machine which permits each needle to form high and low loops within a selected number of stitches, there being a predetermined number of high and low loops formed.

It is a further object of the present invention to provide a simple pattern attachment for a tufting machine having a single set of slats mounted for rotation in timed relationship with the reciprocating cycle of the tufting machine, each slat having a groove corresponding to a respective needle formed in the periphery to a selected depth for varying the tension on a strand of yarn fed at a constant rate to the corresponding needle to permit the needle to be supplied either with an amount of yarn adequate to meet the yarn requirements of the needle to form a stitch or a lesser amount of yarn resulting in back-robbing of yarn from the previous stitch to form a stitch, each slat of the set corresponding to a different stitch.

Accordingly, the present invention provides a pattern attachment disposed, between a yarn feeding device and the needles of a tufting machine, the yarn feeding device feeding yarn at a constant irate toward the needles, the pattern attachment having a plurality of slats driven about a closed loop, each slat having yarn receiving grooves or slots formed therein to at least two different depths, and a pair of yarn guides disposed closely to the pattern attachment, one yarn guide being between the feeding device and the attachment for guiding yarn into the pattern attachment and the other guide being between the attachment and the needles for guiding yarn from the pattern attachment, the two guides being located such that the yarn continuously is directed into the grooves or slots of the slats. The deep grooves permit the full amount of yarn fed by the feeding device to be received by the needle, while the shallow grooves apply a greater tension to the yarn so that the needle receives less yarn and thus requires yarn to be back-robbed from stitches previously formed resulting in such previous stitches being shortened loops.

In the preferred form of the invention the slats are mounted to rotate in a circular path and the yarn guides effect a tight wrapping about a number of slats within a sector of the circular path. The driving of the slats is provided by connecting the slats to the links of chains trained about corresponding sprockets, the sprockets being driven in timed relationship to the tufting machine. The pitch or distance between the periphery of adjacent slats may correspond to one stitch so that each stitch is controlled by one slat. Thus, a very simple mechanical pattern attachment is provided which provides a pattern having a substantially random look relative to that formed by eccentrically mounted grooved cam disks since it effectively provides disks having diameters that change or vary about the periphery.

BRIEF DESCRIPTION OF THE DRAWINGS

The particular features and advantages of the invention as well as other objects will become apparent from the following description taken in connection with the accompanying drawings in which.

DESCRIPTION OF THE REFERRED EMBODIMENT

Figure 1:
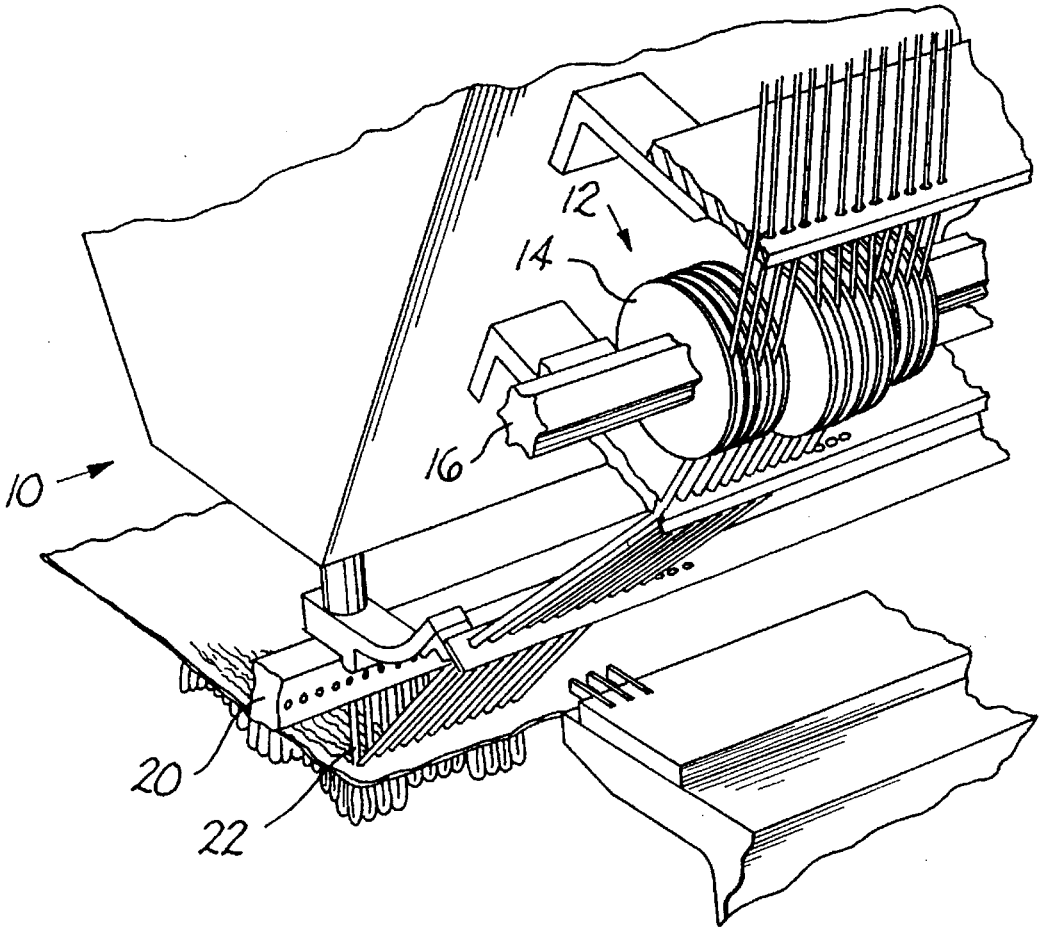
PRIOR ART FIG. 1
FIG. 1 is a fragmentary perspective view of a tufting machine illustrating a prior art pattern device.

Referring to the drawings, a tufting machine 10 is illustrated in FIG. 1 having a cam disk pattern attachment constructed in accordance with the prior art, the pattern attachment being mounted on the tufting machine for producing the simplest variations in pile height. The pattern attachment 12 comprises a series of grooved disks 14 eccentrically mounted on a drive shaft 16 driven in timed relationship with the tufting machine push rods and thus the tufting machine needle bar 20. There is one disk for each yarn end, i.e., for each threaded needle 22. The drive shaft 16 is splined so that the disks may be selectively mounted thereon in different angular phases As the disks rotate eccentrically the tension of the yarns running in the respective grooves changes and, as a result, differences in pile height are created. As aforesaid, this apparatus is limited to very simple high and low loop patterns with very small repeats.

Figure 2:
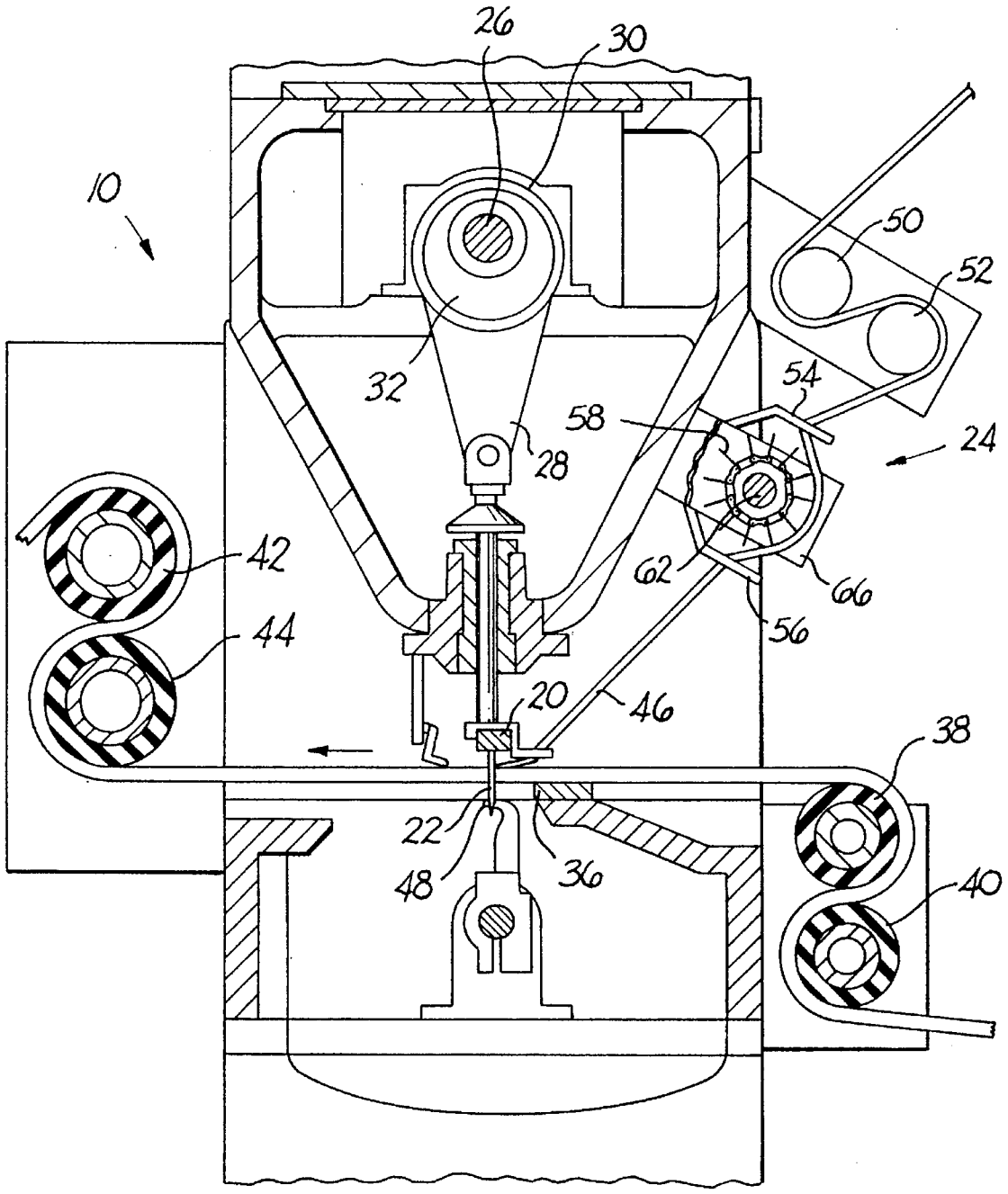
FIG. 2 is a vertical cross sectional view taken through a tufting machine having a pattern attachment constructed in accordance with the principles of the present invention mounted thereon.

As illustrated in FIG. 2, a pattern attachment 24 constructed in accordance with the present invention is mounted on a conventional tufting machine 10 having push rods driven from the main shaft 26 by conventional drive means such as a connecting rod 28 having an eccentric strap 30 mounted about an eccentric disk or cam 32 secured on the main shaft 26. The needle bar 20 and thus the needles 22 are reciprocated vertically into and out of a backing material 34 fed across a bed plate 36 by conventional feed rolls 38, 40 and take-up rolls 42, 44. Yarn 46 fed to each needle is formed into a loop by the needle, the loop being seized and shed by a looper 48 pointing in the direction of movement of the backing material 34 and oscillating in the bed of the tufting machine beneath the bed plate 36 in timed relationship to the reciprocation of the needles to produce a pile loop during each cycle of the machine.

In order to provide a pattern effect of at least high and low loops the pattern attachment 24 of the present invention is mounted intermediate the needles 22 and a yarn feed device such as conventional feed rollers 50, 52 about which the yarn 46 is trained so as to feed a constant rate or fixed amount of yarn toward each needle. Furthermore, the pattern attachment is mounted intermediate a pair of yarn guides 54 and 56, the pattern attachment being closely proximate the yarn guides for reasons which hereinafter will become clear.

Figure 3:
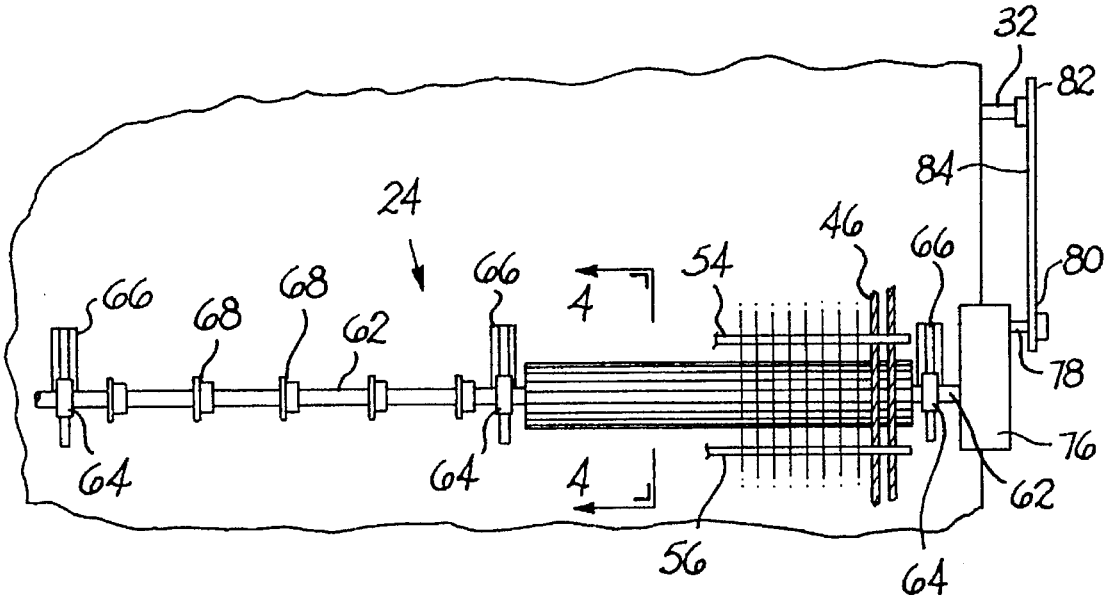
FIG. 3 is a fragmentary elevational view of the tufting machine illustrated in FIG. 2 depicting the pattern attachment.
Figure 4:
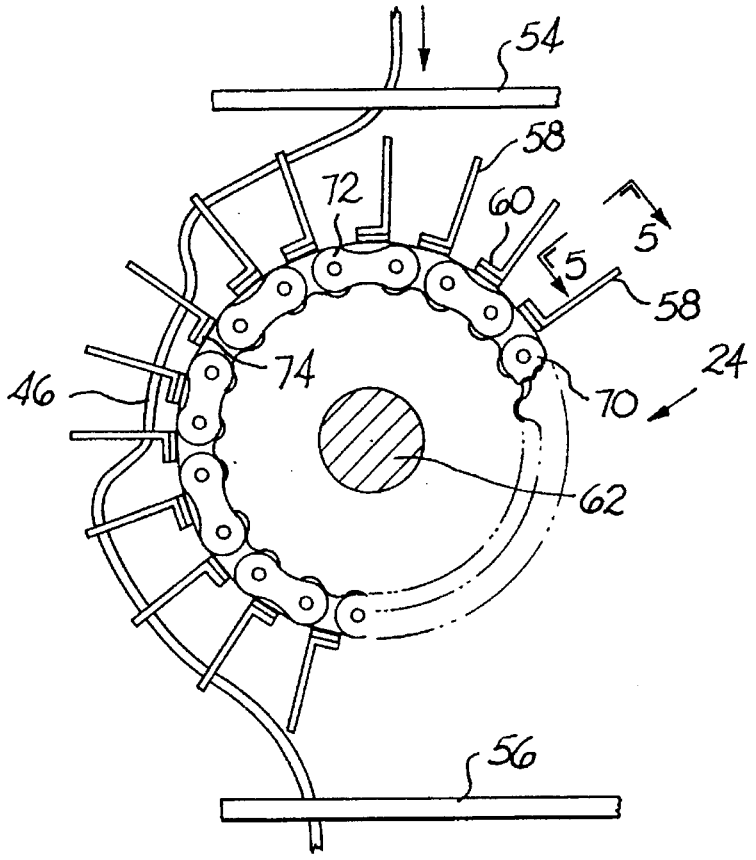
FIG. 4 is a cross sectional view taken substantially along line 4—4 of FIG. 3.

Referring to FIGS. 3 and 4 it may be seen that the pattern attachment 24 comprises a plurality of elongated substantially rectangular shaped slats 58, each slat having a tab 60 extending substantially perpendicular to the body of the respective slat along one edge, the other edge having patterning grooves generally indicated at 65 cut therein. An elongated shaft 62 extending substantially transverse to the tufting machine, i.e., transverse to the direction of movement of the backing material 34, is supported by bearings 64 carried by brackets 66 secured to the head of the tufting machine at spaced apart locations. Secured to the shaft 62 at spaced locations intermediate each pair of bearings 64 is a respective sprocket 68. A chain 70 having a plurality of pairs of links 72 are trained about each sprocket 68, each pair of links having a lug or tab 74 connected thereto on the surface remote from the sprocket. The tab 60 on each slat 58 is secured as by screws or the like to a tab 74 of a pair of links on each of the sprockets so that each slat is connected to and spans a number of chains and sprockets which form an elongated section of the pattern attachment, there being a number of sections transversely aligned across the width of a full length tufting machine. At least at one end of the pattern attachment, the shaft 62 is connected to the output of a reducer gear box 76 having an input shaft 78 on which a sprocket 80 is mounted. A similar sprocket 82 is mounted on the end of the main shaft 32 and a chain 84 is trained about the sprockets 80 and 82 to drive the shaft 62 and thus the slats 58 in timed relationship to the tufting machine dependent upon the reduction ratio of the gear box. It is thus clear that the slats 58 rotate about a circular path. In a preferred mode, the distance between the ends of diametrically opposed slats is approximately six inches and there are 20 slats. The slats may be rotated at a speed such that control is provided by one slat per stitch resulting in substantially 20 stitches being formed for each revolution of the slats, so that there are substantially 20 stitches in each pattern before the pattern is repeated, or the slats may be rotated faster resulting in less stitches being formed for each revolution of the slats so there would be less stitches in the pattern repeat. Moreover, by use of variable speed means, rotational speed of the slats may be varied selectively.

Figure 5:
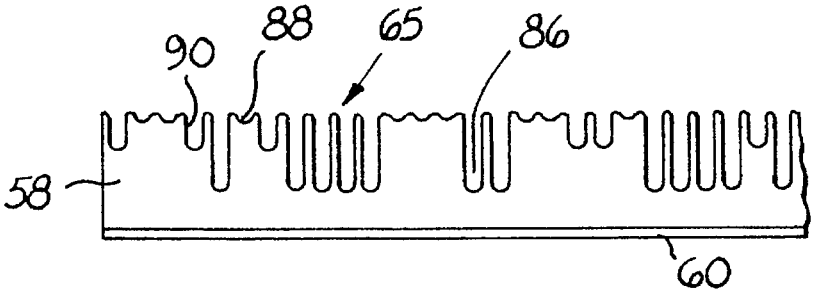
FIG. 5 is an elevational view of a representative slat in the pattern attachment of the present invention as viewed along line 5—5 of FIG. 4.

As illustrated in FIG. 5, the slats 58 include the patterning grooves 65 cut therein from the outer edge, i.e., the edge remote from the chains 70 and sprockets 68. These patterning grooves are cut to various depths depending upon the pattern. For example, there are at least deep grooves 86 and shallow grooves 88, the deep grooves resulting in high height loop pile and the shallow grooves resulting in low height loop pile in the fabric produced, as will hereinafter be made clear. Additionally, if desired, grooves of an intermediate depth 90 may be cut into the slats for forming a loop pile of an intermediate height loop.

As illustrated, the yarn guides 54 and 56 are disposed in relatively close proximity to the pattern attachment 24 so as to guide the yarn 46 into and out of the grooves of the first and last slat of the slats which are disposed about a sector of the array of slats. The tension applied to the yarn between the needle and the yarn creel on which the spools of yarn are mounted, and the yarn feeding rate of the feed rolls 50, 52, are adjusted so that the needles are fed an amount of yarn adequate to meet the needle requirements to form a stitch in conjunction with the respective loopers to thus produce a high pile height loop. The tension applied between the creel and the needles ensures that the yarns may engage the valleys of the deep grooves 86 in the slats unless, for example, the slat with the deep groove is between a pair of slats with shallow grooves. When a shallower groove such as the grooves 88 or the grooves 90 contacts the yarn, the yarn requirements of the corresponding needle are not then met so that yarn must be pulled back or back-robbed from at least the last stitch thereby reducing the height of the loop of the previous stitch to create a shorter loop. Accordingly, each needle may produce a high loop and a low loop and, if desired, a loop of an intermediate height.

In effect, the grooves of the plurality of slats form rolls of varying diameter. This may be seen in FIG. 4 where the yarn strand 46 serpentines closer and further to the axis of the shaft 62. Of course, if one or more needles are to produce a loop of constant height for a given number of stitches, such that the grooves of all the slats corresponding to that needle for that number of stitches are cut to the same depth for the slats in the sector corresponding thereto, the yarn strand engaging the grooves in that sector would remain at a fixed distance from the axis of the shaft 62. When using 20 slats, as aforesaid, with a pitch substantially equal to a stitch, each needle may produce a random 20 stitch high/low pattern, and since each other needle may produce a different 20 stitch pattern, the present invention provides a simple pattern attachment for producing structured random looking patterns in a very inexpensive manner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine, means for feeding a base material in one direction, a yarn carrying needle disposed on one side of said base material, means for reciprocating said needle for penetrating said base material and forming loops therein, a looper disposed on the other side of said base material from said needle and having a free end pointing in the direction of feed of said base material for seizing and shedding the loops in succession, yarn feed means for feeding yarn to said needle at a constant rate in an amount sufficient to accommodate the yarn requirements of said needle to form a loop at a disposition for seizing by said looper, a pattern attachment separate from said feed means disposed intermediate said feed means and said needle for selectively pulling yarn from said needle so that the amount of yarn fed to said needle is inadequate to accommodate said yarn requirements, said pattern attachment comprising a plurality of slats mounted for movement about an axis, means for moving said slats about said axis in timed relationship to the reciprocation of said needle, each of said slats having a groove formed on a distal end, the grooves in certain of said slats being deeper than the grooves in other of said slats, and yarn guide means comprising a first yarn guide adjacent said attachment for directing yarn from said feed means into the groove of a first of said moving slats, and a second yarn guide adjacent said attachment for receiving yarn from the groove of a second of said moving slats remote from said first slat and directing said yarn to said needle, said yarn being disposed within a groove of each slat in a sector of slats between said first and second slat.

2. In a tufting machine as recited in claim 1, including a plurality of yarn carrying needles reciprocated for penetrating said base material and forming respective loops therein, a looper corresponding to each needle, each of said slats having a plurality of grooves, one groove of each slat corresponding to each needle.

3. In a tufting machine as recited in claim 1, wherein said slats are mounted for rotation about said axis, and said means for moving said slats comprises means for rotating said slats about said axis, said sector comprising an arc of a circle about said axis, said first slat being a slat rotatably entering said sector, and said second slat being a slat rotatably exiting said sector.

4. In a tufting machine as recited in claim 3, including a plurality of yarn carrying needles reciprocated for penetrating said base material and forming respective loops therein, a looper corresponding to each needle, each of said slats having a plurality of grooves, one groove of each slat corresponding to each needle.

5. In a tufting machine as recited in claim 4, wherein said means for rotating said slats comprises a shaft rotatably driven in timed relationship to said needles, a plurality of sprockets mounted on said shaft and rotatable therewith, a chain having a plurality of links mounted on each sprocket, and means for securing each slat to a link at a location spaced from said distal end.

6. In a tufting machine as recited in claim 3, wherein said axis is transverse to the direction of feed of said base material.

* * * * *